US008369724B2

(12) United States Patent
Murayama

(10) Patent No.: US 8,369,724 B2
(45) Date of Patent: Feb. 5, 2013

(54) IMAGE FORMING APPARATUS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 533 days.

(21) Appl. No.: 12/555,015

(22) Filed: Sep. 8, 2009

(65) Prior Publication Data

US 2010/0061740 A1 Mar. 11, 2010

(30) Foreign Application Priority Data

Sep. 9, 2008 (JP) ..... 2008-231250

(51) Int. Cl.
*G03G 15/00* (2006.01)

(52) U.S. Cl. ..... 399/49; 399/72; 399/301

(58) Field of Classification Search ..... 399/49, 399/72, 301

See application file for complete search history.

(56) References Cited

U.S. PATENT DOCUMENTS 5,872,586 A 2/1999 Shio
5,995,802 A * 11/1999 Mori et al. ..... 399/394

FOREIGN PATENT DOCUMENTS

JP 2003-202723 7/2003
JP 2005-346094 12/2005

* cited by examiner

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

An image forming apparatus includes a plurality of forming devices, a measuring device and a correcting device. In execution of a steady-deviation detection, the correcting device controls the forming devices to form a first pattern and detects a steady deviation amount of the image forming position on a basis of a measurement result of the first pattern. In execution of a varying-deviation detection, the correcting device controls at least one of the forming devices to form a second pattern and detects a varying deviation amount of the image forming position having a cycle on a basis of a measurement result of the second pattern. The correcting device determines necessity of executing the other one of the steady-deviation detection and the varying-deviation detection on the basis of the measurement result in the one of the steady-deviation detection and the varying-deviation detection.

7 Claims, 11 Drawing Sheets

IMAGE FORMING APPARATUS

CROSS REFERENCE TO RELATED APPLICATION

This application claims priority from Japanese Patent Application No. 2008-231250 filed on Sep. 9, 2008. The entire content of this priority application is incorporated herein by reference.

TECHNICAL FIELD

The present invention relates to an image forming apparatus, specifically including a function to detect a deviation amount of an image forming position and correct the deviation.

BACKGROUND

A typical type of image forming apparatus includes a plurality of image forming units (forming devices) that are arranged along a sheet conveying belt so as to transfer toner images in different colors one by one to a sheet conveyed on the belt. In order to ensure the quality of the formed images, an art generally referred to as registration and the like has been adopted to this type of image forming apparatus. With the art, the image forming units form a pattern including a plurality of marks on the surface of the belt; an optical sensor measures a position of each mark to detect the deviation amount of the image forming position with respect to each color; then, on the basis of the measurement result, the deviation amount of the image forming position with respect to each color is corrected.

Such an art, generally, is addressed to correct a steady positional deviation amount due to a positional deviation of an image forming unit member (a photosensitive drum, an optical members of an exposure unit) and the like. On the other hand, there is also an art addressed to correct a varying positional deviation amount, which has a specific cycle, due to eccentricity of a photosensitive drum and/or a roller that support(s) the belt, irregularity in pitch of a gear whereby these members are rotationally driven, and the like. With this art, another pattern (a pattern other than the pattern for the steady positional deviation detection) is formed on the belt, the cyclic positional deviation amount of the image forming position is detected, and, on the basis of a result of the detection, the image forming position is corrected.

By frequently performing such positional deviation detection, the quality of the formed image can be maintained. However, more frequent detection causes more consumption of coloring agent and more time for the user to wait. Therefore, there is a need for an image forming apparatus that can perform the positional deviation detection at suitable timings.

SUMMARY

An aspect in accordance with the present invention is an image forming apparatus including: a carrier configured to convey a recording medium; a plurality of forming devices configured to form respective images at respective image forming positions on the recording medium, wherein the plurality of forming devices form a pattern on the carrier; a measuring device configured to measure the pattern formed on the carrier; and a correcting device configured to execute at least one of a steady-deviation detection and a varying-deviation detection with respect to the at least one of the plurality of forming devices and, on a basis of a result of the at least one of the steady-deviation detection and the varying-deviation detection, correct the image forming position of the at least of one of the plurality of forming devices. In execution of the steady-deviation detection, the correcting device controls the plurality of forming devices to form a first pattern, controls the measuring device to measure the first pattern, and detects a steady deviation amount of the image forming position on a basis of a measurement result of the first pattern by the measuring device. In execution of the varying-deviation detection, the correcting device controls at least one of the plurality of forming devices to form a second pattern, controls the measuring device to measure the second pattern, and detects a varying deviation amount of the image forming position on a basis of a measurement result of the second pattern by the measuring device, the varying deviation amount of the image forming position having a cycle. The correcting device determines necessity of executing the other one of the steady-deviation detection and the varying-deviation detection on the basis of the measurement result of the measuring device in the one of the steady-deviation detection and the varying-deviation detection, and, upon determination that execution of the other one of the steady-deviation detection and the varying-deviation detection is necessary, executes the other one of the steady-deviation detection and the varying-deviation detection.

With this aspect, the correcting device executes one of the steady-deviation detection and the varying-deviation detection so that the measuring device obtains the measurement result and determines necessity of executing the other one of the steady-deviation detection and the varying-deviation detection on the basis of the measurement result. Therefore, in comparison with execution of the other one of the steady-deviation detection and the varying-deviation detection simply on regular basis, consumption of coloring agent can be reduced, and the time needed for the detection process can be saved.

DETAILED DESCRIPTION

First Illustrative Aspect

A first illustrative aspect in accordance with the present invention will be described with reference to FIGS. 1 through 9.

(Schematic Configuration of Printer)

Figure 1:
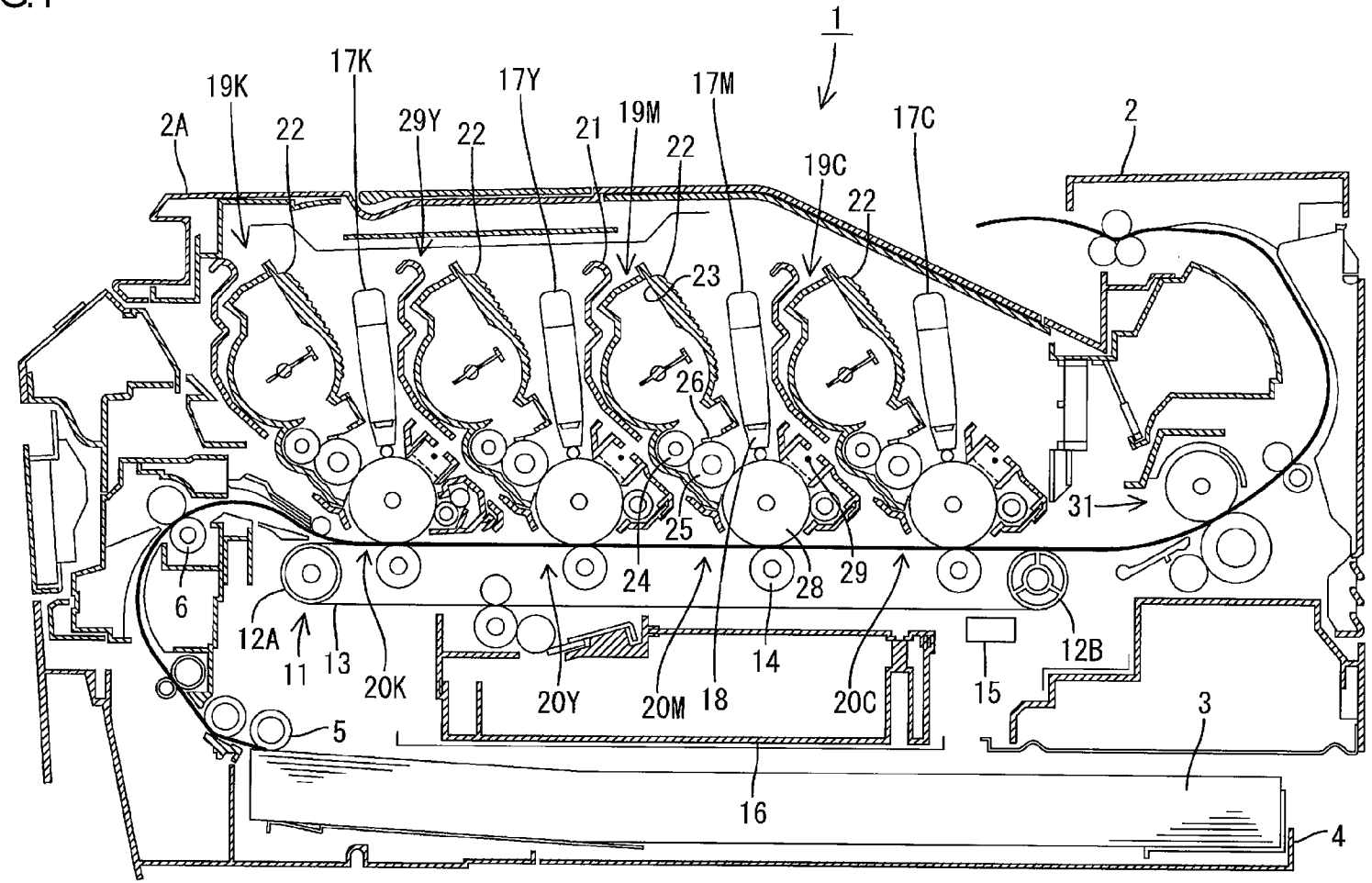
FIG. 1 is a side sectional view illustrating a schematic configuration of a printer of a first illustrative aspect in accordance with the present invention.

FIG. 1 is a side sectional view illustrating a schematic configuration of a printer 1 (an illustration of an image forming apparatus). The printer 1 of this illustrative aspect is a printer of a direct-tandem type that can form a color image using toner in four colors (black K, yellow Y, magenta M, and cyan C). The left side in FIG. 1 represents the front side of the printer 1. Note that some of reference characters of identical components for different colors are omitted in FIG. 1.

The printer 1 includes a body casing 2, an openable cover 2A, a sheet tray 4, a sheet-feed roller 5, a registration roller 6, and a belt unit 11. The cover 2A is disposed on the top of the body casing 2. The sheet tray 4 is disposed in a bottom portion of the body casing 2 such that a plurality of sheets 3 (each sheet 3 is an illustration of a recording medium) can be stacked therein. The sheet-feed roller 5 is disposed above the front side of the sheet tray 4. As the sheet-feed roller 5 rotates, a sheet 3 stacked uppermost in the sheet tray 4 is sent toward the registration roller 6. The registration roller 6 corrects skew of the sheet 3 and, thereafter, conveys the sheet 3 onto the belt unit 11.

The belt unit 11 includes a belt support roller 12A disposed at the front side thereof, a belt drive roller 12B disposed at the rear side thereof, and a loop belt 13. The belt 13 (an illustration of a carrier) is made of polycarbonate and the like and is stretched between the belt support roller 12A and the belt drive roller 12B so as to loop them. Transfer rollers 14 are disposed inside the loop of the belt 13 each at positions opposed to the photosensitive drums 28 of respective process units 19K, 19Y, 19M, 19C (described below) across the belt 13. When the cover 2A of the body casing 2 is open and the process units 19K-19C are removed outward, the belt unit 11 can be installed in, or removed from, the body casing 2.

When the belt unit 11 is installed in the body casing 2, the belt drive roller 12B is connected via a gear mechanism (not illustrated) to a drive motor 47 (see FIG. 2) mounted in the body casing 2. Then, the belt drive roller 12B is rotationally driven under the power of the drive motor 47, and this rotational drive circulates the belt 13 clockwisely in the figure, so that the sheet 3 held on an upper surface of the belt 13 by static electricity is rearwardly conveyed.

A pattern detection sensor 15 (an illustration of a measuring device) is opposed to a lower and outer surface of the belt 13. The pattern detection sensor 15 can detect patterns and the like formed on the belt 13. When light is emitted from a light source to the belt 13 and is reflected by the belt 13, the pattern detection sensor 15 receives the reflected light at a photodiode thereof and outputs an electric signal corresponding to an intensity of the received light. Furthermore, a cleaning unit 16 is disposed below the belt unit 11. The cleaning unit 16 can collect toner, paper powder, and the like that are attached to the surface of the belt 13.

Four exposure units 17K, 17Y, 17M, 17C and the respective process units 19K, 19Y, 19M, 19C are arranged in tandem above the belt unit 11. The exposure units 17K-17C, the respective process units 19K-19C, and the respective transfer rollers 14 configure respective four image forming units 20K, 20Y, 20M, 20C (an illustration of forming devices). Thus, the printer 1 as a whole has the image forming units 20K, 20Y, 20M, 20C corresponding to black, yellow, magenta, and cyan, respectively.

The exposure units 17K-17C are supported by a lower surface of the cover 2A. Each of the exposure units 17K-17C includes a LED head 18 having a plurality of LEDs arranged in line on the bottom end thereof. At a time of exposure, the exposure units 17K-17C emit light from the respective LED heads 18 thereof to the surfaces of the respective photosensitive drums 28 under light emission control based on a data of the forming image.

Each of the process units 19K-19C includes a cartridge frame 21 and a developer cartridge 22 removably attached to the cartridge frame 21. When the cover 2A is opened, the exposure units 17K-17C are removed upwardly and outwardly following the cover 2A so as to allow each of the process units 19K-19C to be separately attached to, or removed from, the body casing 2.

Each developer cartridge 22 includes a toner chamber 23, a supply roller 24, a developer roller 25, and a layer-thickness regulating blade 26, and the like. Each toner chamber 23 stores toner (developer) in a color. The supply roller 24, the developer roller 25, and the layer-thickness regulating blade 26 are disposed below the toner chamber 23. Toner released from the toner chamber 23 is supplied to the developer roller 25 by rotation of the supply roller 24 and is positively charged by friction between the supply roller 24 and the developer roller 25. Then, along with rotation of the developer roller 25, the toner supplied to the developer roller 25 enters a gap between the layer-thickness regulating blade 26 and the developer roller 25. The toner is still more sufficiently charged by friction there and is carried as a uniform thickness of thin layer on the developer roller 25.

The photosensitive drum 28 and a charger 29 of a scorotron type is disposed below each cartridge frame 21. The photosensitive drum 28 is covered with a photosensitive layer having a surface with a positive charge property. At a time of image formation, the photosensitive drums 28 are rotationally driven and, along with this, the surfaces of the photosensitive drums 28 are uniformly and positively charged by the respective chargers 29. Then, the positively charged surfaces are exposed by scanning of the exposure units 17K-17C. Thus, an electrostatic latent image is formed on the surface of each of the photosensitive drum 28.

Next, the toner positively charged and carried on the developer roller 25 is supplied to the electrostatic latent image on the surface of the photosensitive drum 28, so that the electrostatic latent image on the photosensitive drum 28 is visualized. Thereafter, while the sheet 3 passes through each of points pinched by the photosensitive drums 28 and the respective transfer rollers 14, the toner images carried on the surfaces of the photosensitive drums 28 are transferred onto the sheet 3 one by one under the negative transfer voltage applied to the transfer rollers 14. Next, the sheet 3 carrying the transferred toner image is conveyed to a fixing unit 31, where the toner image is fused. Thereafter, the sheet 3 is conveyed upwardly and is ejected onto a top surface of the cover 2A.

(Electrical Configuration of Printer)

Figure 2:
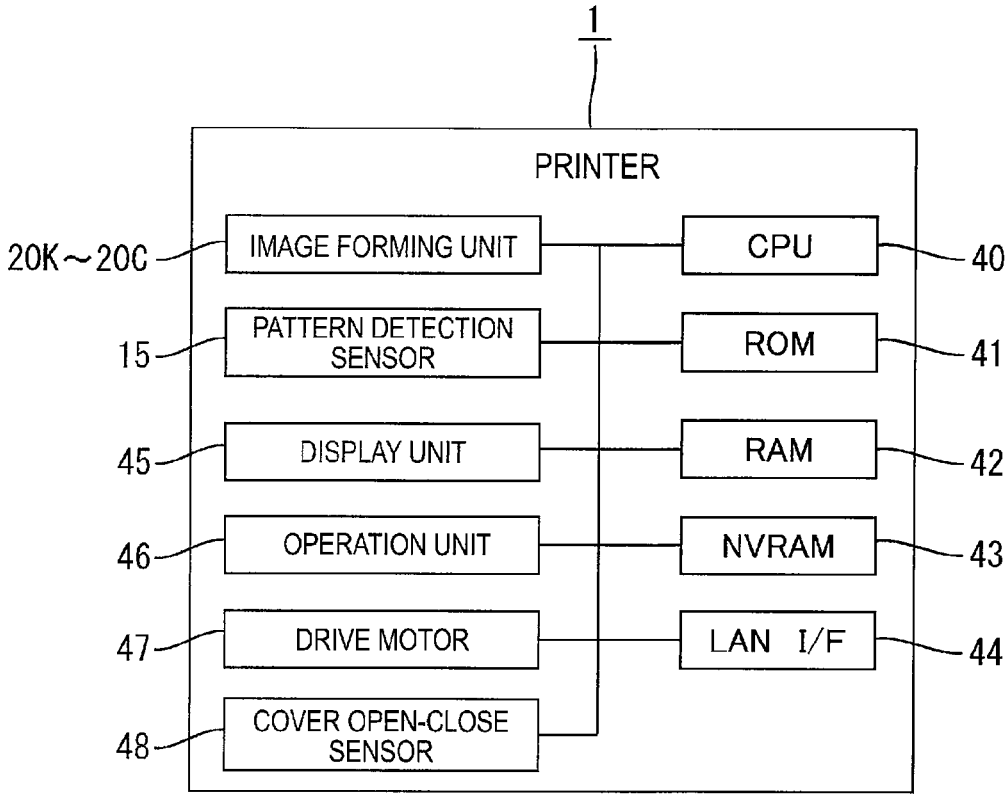
FIG. 2 is a block diagram schematically illustrating an electrical configuration of the printer.

FIG. 2 is a block diagram schematically illustrating an electrical configuration of the printer 1.

As shown in FIG. 2, the printer 1 includes a CPU 40 (an illustration of a correcting device), a ROM 41, a RAM 42, an NVRAM (nonvolatile random access memory) 43, and a network interface 44. These members are connected to the image forming units 20K-20C, the pattern detection sensor 15, a display unit 45, an operation unit 46, the drive motor 47, and a cover open-close sensor 48, and the like.

A program for the printer 1 to execute processes (such as a positional deviation detection process, which will be described below) is stored in the ROM 41. The CPU 40 reads out the program form the ROM 41 and, according to the program, controls each unit while storing a result of the process in the RAM 42 or in the NVRAM 43. The network interface 44 is connected to an external computer (not illustrated) via a communication line such that mutual data communication is available.

The display unit 45 includes a liquid crystal display, a lamp, and the like so as to display various setting windows, operating conditions of the printer 1, and the like. The operation unit 46 includes a plurality of buttons that the user can manipulate for the purpose of various kinds of input. The drive motor 47 includes a plurality of motors. The registration roller 6, the belt drive roller 12B, the developer rollers 25, and the photosensitive drums 28 are rotationally driven by the drive motor 47 via gear mechanisms (not illustrated). The cover open-close sensor 48 detects an open-close state of the cover 2A and outputs a detection signal.

(Positional Deviation Detection Process)

Figure 3:
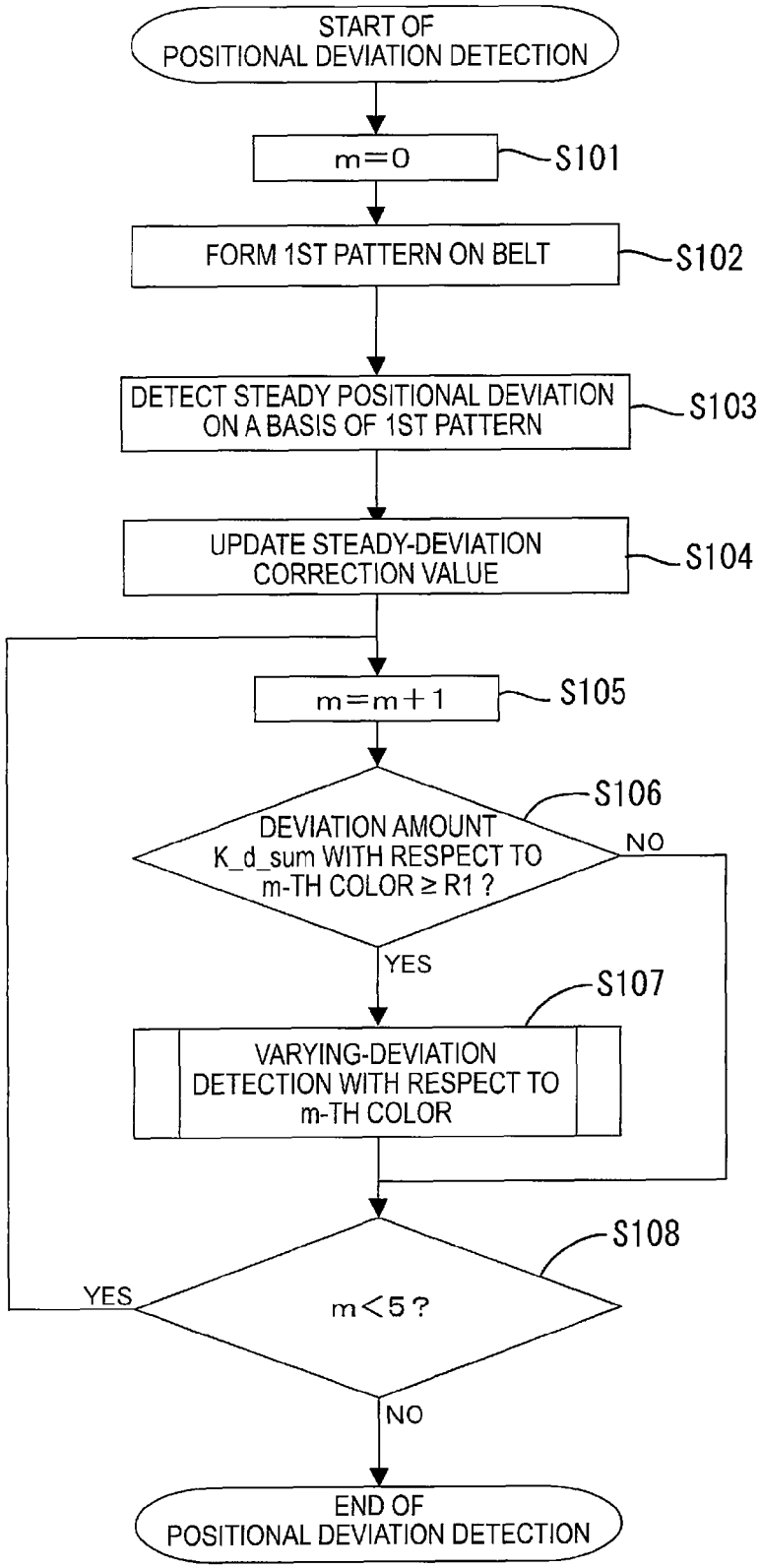
FIG. 3 is a flowchart illustrating a positional deviation detection process.
Figure 4:
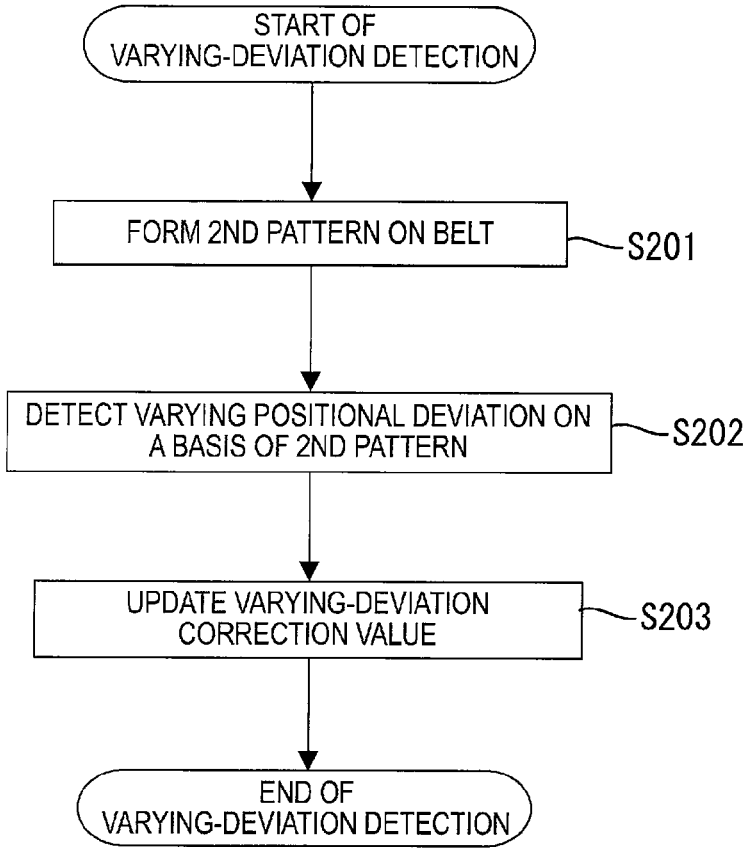
FIG. 4 is a flowchart illustrating a part of the positional deviation detection process.
Figure 5:
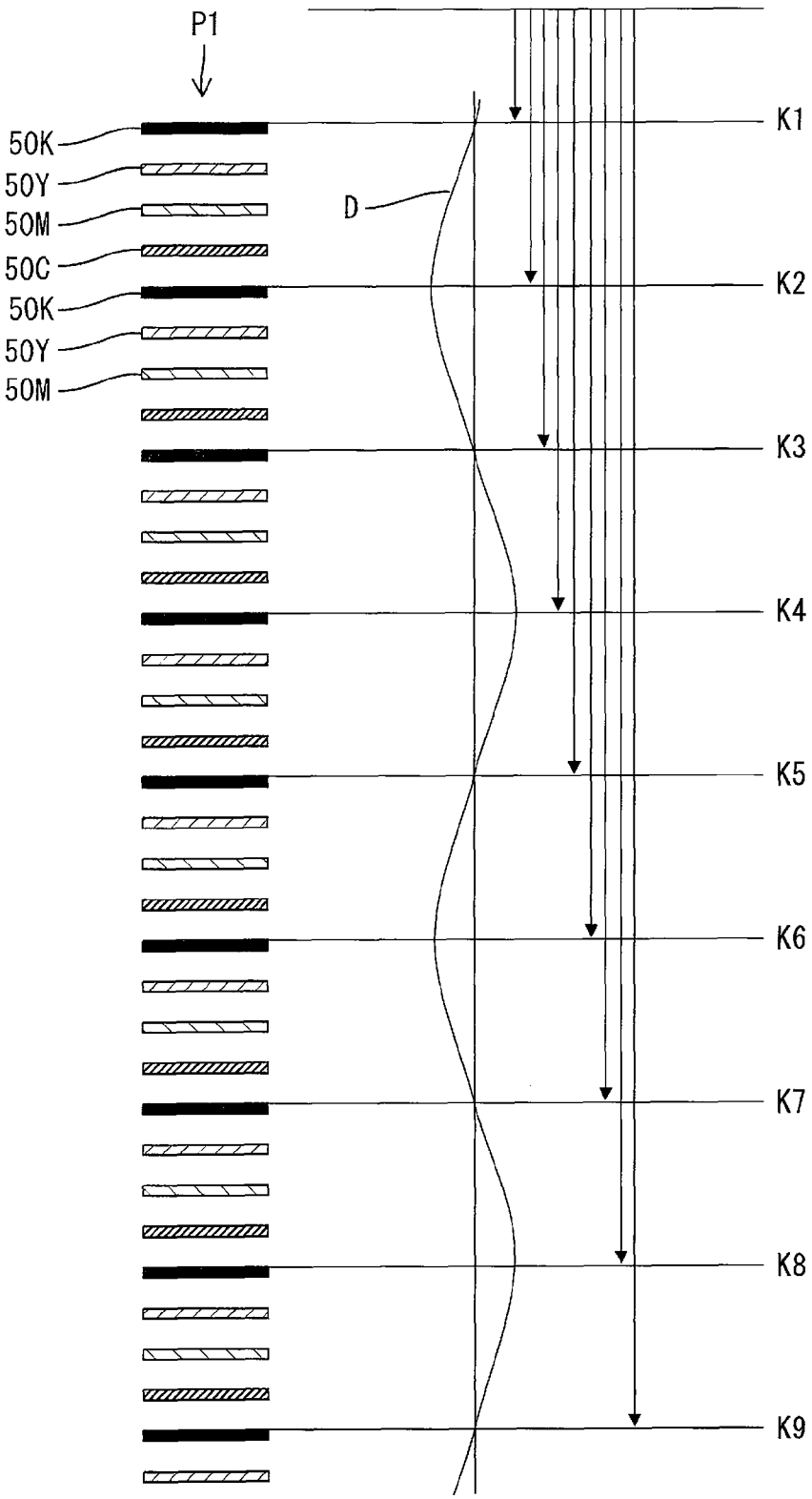
FIG. 5 is an illustration of a first pattern.
Figure 6:
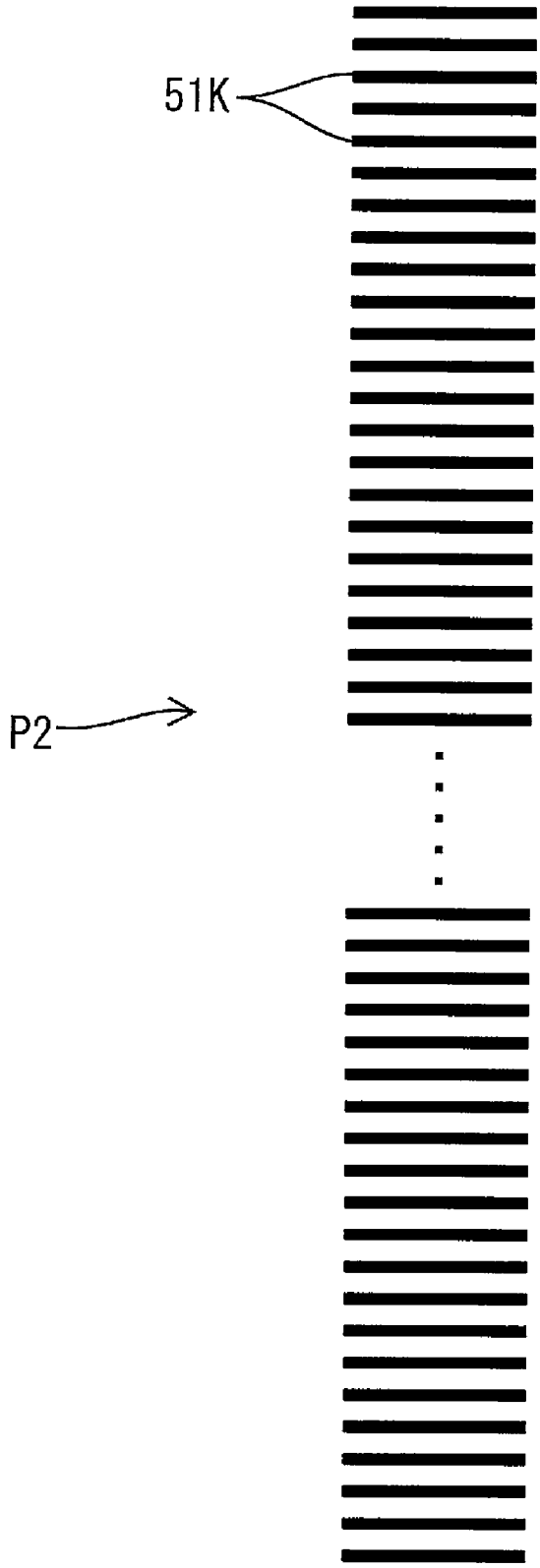
FIG. 6 is an illustration of a second pattern.
Figure 7:
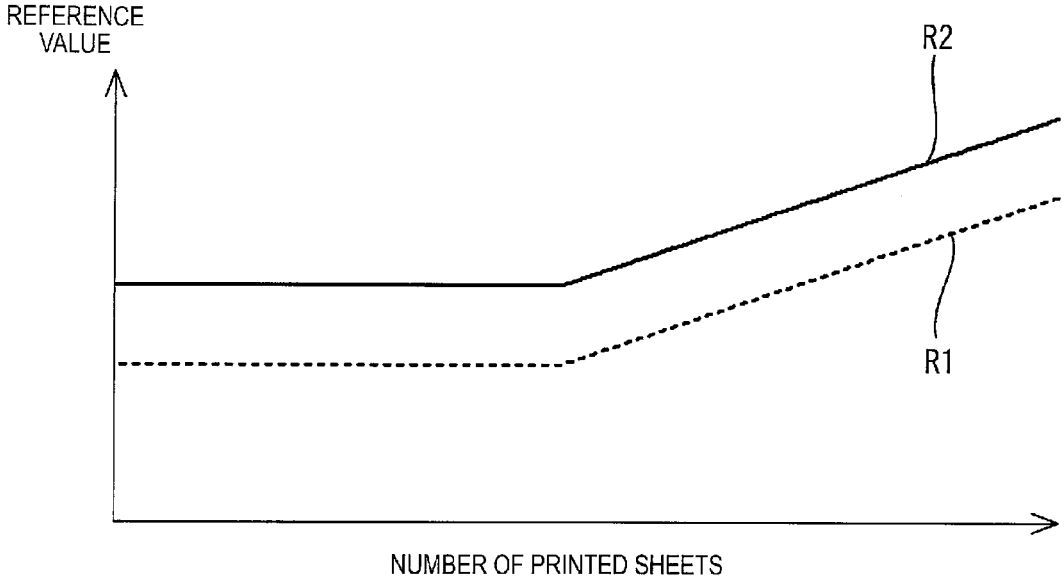
FIG. 7 is a graph illustrating a relationship between reference values for determining necessity of a varying-deviation detection and a number of printed sheets.

The action of the positional deviation detection process executed by the printer 1 will hereinafter be described. FIGS. 3 and 4 are flowcharts illustrating the positional deviation detection process. FIG. 5 is an illustration of a first pattern P1, while FIG. 6 is an illustration of a second pattern P2. In addition, FIG. 7 is a graph illustrating a relationship between reference values and a number of printed sheets. Note that the reference value is provided for determining necessity of varying-deviation detection.

The positional deviation detection process is executed under control performed by the CPU 40 when a predetermined condition is met, e.g. right after the power is turned on, when open-close of the cover 2A is detected, when a predetermined time from a previous positional detection process has elapsed, or when print of a predetermined number of sheets are completed.

When the positional deviation detection process as illustrated in FIG. 3 starts, the CPU 40 sets 0 (zero) to the value of a parameter m that represents the order of each color (S101). Next, the CPU 40 controls the image forming units 20K-20C to form the first pattern P1 on the belt 13 (S102). More specifically, the NVRAM 43 or the like stores a steady-deviation correction value and a varying-deviation correction value for correcting a deviation amount of the image forming position with respect to each color, which will be described below. The CPU 40 reads these values, adds corrections to a data to be supplied to the exposure units 17K-17C of the image forming units 20K-20C, and, thereafter, forms the first pattern P1.

As illustrated in FIG. 5, the first pattern P1 has marks 50K, 50Y, 50M, 50C in each color. Each of the marks 50K, 50Y, 50M, 50C is elongated in a main scanning direction (in a widthwise direction of the belt 13) and narrow. More specifically, the first pattern P1 has a plurality of mark sets each having four (black, yellow, magenta, and cyan, arranged in this order) marks 50K-50C. The plurality of mark sets are arranged with intervals in a vertical scanning direction (in the moving direction of the belt 13) over the entire circumference of the belt 13. If the marks 50K-50C are formed at ideal positions without any positional deviation, the intervals between adjacent marks 50K-50C are equal.

Note that a wavy line D illustrated at the right side of the marks 50K-50C in FIG. 5 is an illustration of a magnitude of a cyclic positional deviation amount of the black image forming position in the vertical scanning direction. In the line D, portions at the left side of the centerline represent the upward (frontward) deviation from the ideal positions, while portions at the right side represent the downward (rearward) deviation from the ideal positions. The cycle of the wavy line D corresponds to a rotation cycle of, for example, one of the photosensitive drums 28, the belt drive roller 12B, another gear member, and the like.

Next, while marks 50K-50C of mark sets pass the detection position at respective time points, the CPU 40 measures the time points and outputs the detection signal using the pattern detection sensor 15 (S103). Then, on the basis of the detection signal (the measurement result), the CPU 40 calculates the positional deviation amount of each mark (other than the black marks) 50Y, 50M, 50C from the ideal position based on the black mark 50K in the same marks set in the vertical scanning direction. Note that, hereinafter, the black color, the colors other than black, and the black marks 50K are referred to as a reference color, corrected colors, and reference marks, respectively. Thereafter, the CPU 40 averages the positional deviation amounts of the mark positions in all mark sets on the color basis. Then, the CPU 40 adds each compensating value to the steady-deviation correction value (stored in the NVRAM 43 or the like) for each corrected color. Note that the compensating values are values that compensate the respective average positional deviation amounts of the marks on the color basis. The steady-deviation correction values for the corrected colors are thus updated (S104).

Thereafter, the CPU 40 adds 1 to m (S105) and determines necessity of the varying-deviation detection with respect to the image forming unit 20K-20C corresponding to the m-th color (S106). Note that the necessity of the varying-deviation detection is determined on the basis of the magnitude of the cyclic positional deviation amount that is calculated on the basis of the measurement result of the first pattern P1 in the previous steady-deviation detection (S102-S104). In this illustrative aspect, the magnitude of the cyclic positional deviation amount is calculated by averaging the positional deviation amounts. The process of calculating the magnitude of the cyclic positional deviation amount of the first color (black) will hereinafter be described.

First, suppose that K1 to Kn are times from a measurement start time point to detection time points of a first to an n-th black marks 50K, respectively. Then, the CPU 40 calculates an average K_Ave of times from K1 to Kn using Formula 1 as follows:

$$K_\mathrm{Ave}=(K1+K2+\ldots+Kn)/n \qquad \text{[Formula 1]}$$

Now, suppose that K1*i* is an detection time of the first mark 50K when the first mark 50K is positioned at the ideal position. Similarly, suppose that Kni is a detection time of the n-th mark 50K when the n-th mark 50K is positioned at the ideal position. Furthermore, suppose that K_Avei is an average (calculated using a formula similar to Formula 1) of K1*i* to Kni when all marks 50K are positioned at the respective ideal positions. Furthermore, suppose that K1*t* is a difference between the average K_Avei and the detection time K1*i*. Then, K1*t* is denoted by Formula 2 as follows:

$$K1t=K_\mathrm{Avei}-K1i \qquad \text{[Formula 2]}$$

Similarly, suppose that K2*t* to Knt are differences between the average K_Avei and respective detection times K2*i* to Kni where the second to the nth marks 50K are positioned at the respective ideal positions.

Then, the CPU 40, using Formula 3 as follows, calculates a deviation amount (a deviation time) K1_d of the first mark 50K from the ideal position:

$$K1_d=K_\mathrm{Ave}-K1-K1t \qquad \text{[Formula 3]}$$

Similarly, the CPU 40 calculates deviation amounts K2_d to Kn_d of the second to the n-th marks 50K, respectively, from the respective ideal positions.

Next, suppose that K1_s is a deviation amount (an absolute value) of the first mark 50K from the ideal position. Then, the CPU 40 calculates the deviation amount K1_s by squaring K1_d and taking its second root, as denoted by Formula 4 as follows:

$$K1_s=\sqrt{(K1_d*K1_d)} \quad \text{[Formula 4]}$$

Similarly, suppose that K2_s to Kn_s are deviation amounts (absolute values) of the second to the n-th marks 50K from the respective ideal positions. Then, the CPU 40 calculates K2_s to Kn_s using a formula similar to Formula 4.

Finally, the CPU 40 calculates the magnitude of the cyclic positional deviation amount (an average value of the deviation from the ideal position) K_d_sum on the basis of the sum of the deviation amounts K1_s to Kn_s of n marks 50K from the respective ideal positions using Formula 5 as follows:

$$K_d_\text{sum}=(K1_s+K2_s+\ldots+Kn_s)/n \quad \text{[FIG. 5]}$$

In order to determine necessity of the varying-deviation detection, the CPU 40 determines whether the magnitude of the cyclic positional deviation amount (the average value of the deviation from the ideal position) K_d_sum as calculated above is equal to or greater than a first reference value R1 (S106 in FIG. 3). As illustrated by a dotted line in FIG. 7, the first reference value R1 changes correspondingly to the number of sheets printed using the current belt unit 11. That is, the first reference value R1 is uniform up to a point corresponding to a predetermined number of printed sheets, while the first reference value R1 increases from the point corresponding to the predetermined number of printed sheets. Note that the CPU 40 stores information related to the number of sheets printed by the printer 1 and a time point where the belt unit 11 is replaced with the current one and, on the basis of this information, obtains the number of sheets printed using the current belt unit 11.

The change of the first reference value R1 as described above copes with a tendency that, after the used amount of the belt unit 11 has increased over a certain amount, the cyclic positional deviation amount starts to increase due to wear-out of the members in accordance with increase in the used amount of the belt unit 11. Note that wear-out of the members includes, for example, wear on a gear that connects the belt drive roller 12B with the drive motor 47. Because the first reference value R1 increases in accordance with the increase in the used amount of the belt unit 11, excessively frequent execution of the varying-deviation detection can be prevented even when wear-out of the belt unit 11 has grown.

If the magnitude of the cyclic positional deviation amount K_d_sum is equal to or greater than the first reference value R1 (S106: Yes), i.e. if the CPU 40 determines that varying-deviation detection is necessary, the CPU 40 executes varying-deviation detection as described below (S107). On the other hand, if K_d_sum is less than the first reference value R1 (S106: No), i.e. if the CPU 40 determines that the varying-deviation detection is unnecessary, the CPU 40 does not execute the varying-deviation detection. Thereafter, if m is a value smaller than 5 (S108: Yes), i.e. if the next color exists, the process returns to S105 so that the CPU 40 determines the necessity of the varying-deviation detection with respect to the next color similarly to the determination with respect to the black color. On the other hand, if m is not a value smaller than 5 (S108: No), i.e. if the CPU 40 has completed determining necessity of the varying-deviation detection with respect to every color, the positional deviation detection process is terminated.

When the varying-deviation detection as illustrated in FIG. 4 starts, first, the CPU 40 forms the second pattern P2 on the belt 13 using one of the image forming units 20K-20C corresponding to the color (S201). The second pattern P2 includes marks 51K in a uniform color (black in this illustrative aspect). As illustrated in FIG. 6, each of the marks 51K is elongated in the main scanning direction and narrow. The marks 51K are arranged at intervals in the vertical scanning direction. The intervals between adjacent marks 51K are smaller than the intervals between adjacent marks 50K-50C of the first pattern P1. The number of marks 51K is greater than the number of the marks 50K of the first pattern P1. If the marks 51K are formed at respective ideal positions without any positional deviations, the intervals between the adjacent marks 51K are equal. In addition, the length of the second pattern P2 in the vertical scanning direction is larger at least than the circumferential length of each of the photosensitive drum 28 corresponding to the color and the belt drive roller 12B.

Next, while each mark 51K of the second pattern P2 passes the detection position of the pattern detection sensor 15 at each of the time points, the CPU 40 measures each time point using the pattern detection sensor 15 and outputs the detection signal. Then, the CPU 40, on the basis of the detection signal (the result of the measurement), detects each cyclic positional deviation amount (in the deviation amount of each mark 51) that matches with the rotation cycle of the corresponding photosensitive drum 28, the belt drive roller 12B, and the like. Thereafter, the CPU 40 adds correction values that compensate the respective varying positional deviation amounts to the respective varying-deviation correction values stored in the NVRAM 43 and the like for the color. The varying-deviation correction value is thus updated (S203), and the varying-deviation detection is terminated.

As a result of the positional deviation detection process as described above, each steady-deviation correction value for each corrected color is updated on the basis of the measurement result of the first pattern P1 and, further, on the basis of the measurement result of the first pattern P1, each of the varying-deviation correction values for the color with respect to which the varying-deviation detection is necessary is updated. At a time of forming images, the CPU 40 reads the steady-deviation correction values and the varying-deviation correction values; then, when each of the exposure units 17K-17C writes each line on the respective one of the photosensitive drums 28, the CPU 40 adjusts each of the writing timing on the basis of these values. More specifically, on the basis of the steady-deviation correction values that are uniform by color, the timing for writing each of the lines in each corrected color is corrected by a steady-deviation amount so that the steady positional deviation in each color in the vertical scanning direction is corrected; further, on the basis of the varying-deviation correction values in accordance with the cyclic fluctuations of the photosensitive drums 28, the belt drive roller 12B, and the like, the timing for writing each of the lines in each color is corrected by each amount corresponding to each variation so that the varying positional deviation in the vertical scanning direction is corrected.

(First Necessity Determination Process)

Figure 8:
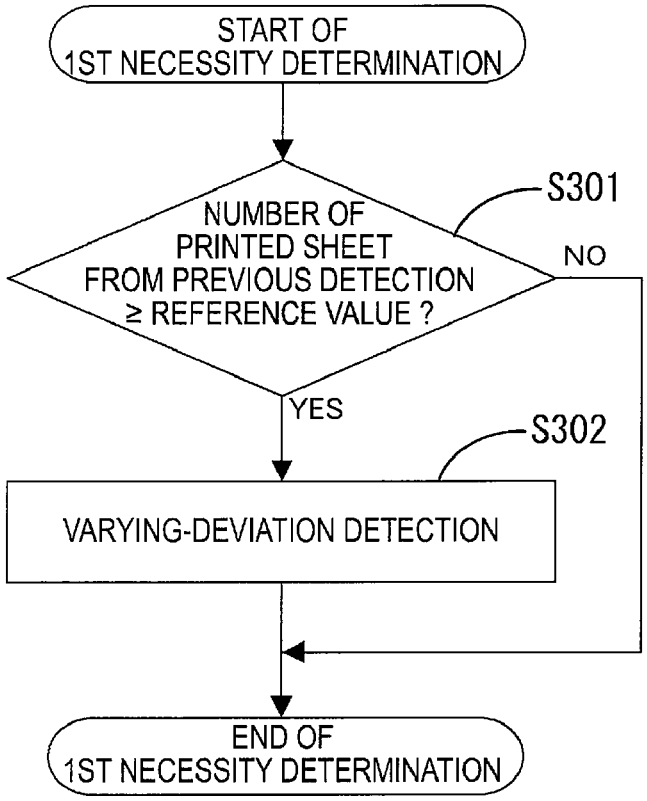
FIG. 8 is a flowchart illustrating a first necessity determination process.

Next, a first necessity determination process for determining necessity of the varying-deviation detection will be described. The first necessity determination process is executed before printing is executed, after printing is executed, and the like. FIG. 8 is a flowchart illustrating a flow of the first necessity determination process.

When the first necessity determination process as shown in FIG. 8 starts, the CPU 40 determines whether the number of sheets printed after the previous varying-deviation detection is executed is equal to or greater than a predetermined reference value (S301). Note that the CPU 40 stores information related to the current number of sheets printed by the printer 1 and the number of sheets printed by a time point where the previous varying-deviation detection is detected. On a basis of this information, the CPU 40 performs the above-described determination. Then, if the number of printed sheets is equal to or greater than the reference value (S301: Yes), the CPU 40 executes the varying-deviation detection with respect to every color. On the other hand, if the number of printed sheets is less than the reference value (S301: No), the CPU 40 terminates the first necessity determination process without executing the varying-deviation detection.

The above-described number of printed sheets corresponds to the number of circulation (or an operation amount) of the belt 13. Therefore, by determining the necessity of the varying-deviation detection on the basis of the number of rotation of the belt 13 counted from the time point of the previous varying-deviation detection, the varying-deviation detection can be executed at suitable timings.

(Second Necessity Determination Process)

Figure 9:
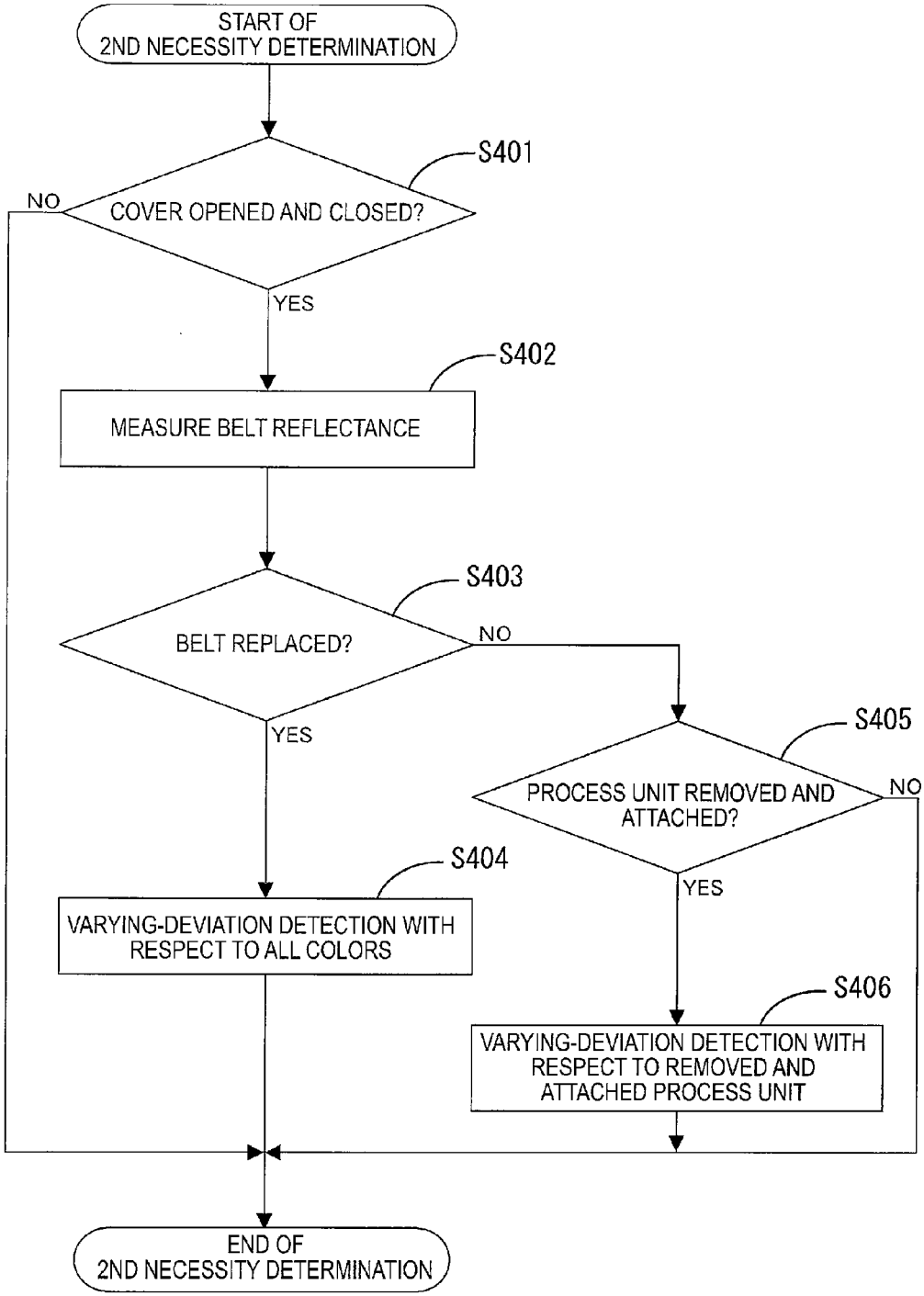
FIG. 9 is a flowchart illustrating a second necessity determination process.

Next, a second necessity determination process will be described. The second necessity determination process is executed on regular basis when the printer 1 is in a standby mode and the like. FIG. 9 is a flowchart illustrating a flow of the second necessity determination process.

When the second necessity determination process as illustrated in FIG. 9 starts, the CPU 40, on the basis of the output from the cover open-close sensor 48, determines whether the open-close operation of the cover 2A has been performed (S401). If the open-close operation has not been performed (S401: No), the CPU 40 terminates the second necessity determination process. On the other hand, if the open-close operation has been performed (S401: Yes), the CPU 40 drives the belt 13 for a predetermined period, and thereafter, the CPU 40 measures a reflectance of the surface of the belt 13 using the pattern detection sensor 15 and outputs the signal and, on the basis of the signal, detects the reflectance of the surface of the belt 13 (S402).

Next, on the basis of the detected reflectance of the surface of the belt 13, the CPU determines whether the belt unit 11 has been replaced with a new one (S403). More specifically, the CPU 40 compares the currently detected reflectance of the surface of the belt 13 with a reflectance previously detected and stored in the NVRAM 43. If the reflectance has increased by a predetermined reference value or more, the CPU 40 determines that the belt unit 11 has been replaced with the new one. On the other hand, if the reflectance has increased by the reference value or less, the CPU 40 determines that the belt unit 11 has not been replaced with the new one. This determination is based on a fact that, while a new belt unit 11 has a higher reflectance due to few scratches, a worn-out belt unit 11 has a lower reflectance due to not a few scratches and stains on the surface thereof.

Thereafter, upon determination that the belt unit 11 has been replaced (S403: Yes), the CPU 40 executes the varying-deviation detection with respect to each of the image forming units 20K-20C (S404) and terminates the second necessity determination process. On the other hand, upon determination that the belt unit 11 has not been replaced (S403: No), the CPU 40 determines whether at least one of the process units 19K-19C has been removed (detached) and attached (S405). Note that these steps may also be such as follows: each of the process units 19K-19C has a member for indicating the usage state; the member moves irreversibly from a new position to a used position when the process unit 19K-19C is first used; a sensor detects the position of the member; and, if the member is at the new position, the CPU 40 determines that the process unit 19K-19C has been replaced with a new one (i.e. removed and attached).

Thereafter, if at least one of the process units 19K-19C has been detached and attached (S405: Yes), the CPU 40 performs the varying-deviation detection only with respect to the image forming unit(s) 20K-20C having the removed (detached) and attached process unit(s) 19K-19C (S406); thereafter, the CPU 40 terminates the second necessity determination process. On the other hand, if none of the process units 19K-19C has been detached and attached (S405: No), the CPU 40 terminates the second necessity determination process without executing the varying-deviation detection.

(Effect of First Illustrative Aspect)

With the first illustrative aspect as described above, after the steady-deviation detection is executed, necessity of executing the varying-deviation detection is determined on the basis of the measurement result of the first pattern P1 measured by the pattern detection sensor 15. This enables execution of the varying-deviation detection at suitable timings. Therefore, in comparison with periodic executions of the varying-deviation detection, toner (coloring agent) consumption can be reduced, and the time needed for the detection process can be saved.

Furthermore, necessity of the varying-deviation detection is determined with respect to each of the image forming units 20K-20C, while the varying-deviation detection is executed only with respect to the one for which the varying-deviation detection is determined to be necessary. Therefore, in comparison with execution of the varying-deviation detection always with respect to each image forming unit 20K-20C, toner consumption can be reduced, and the time needed for the detection process can be saved.

In addition, the steady positional deviation amounts are calculated on the basis of the positional relationship (first relationship) between the marks 50K-50C in the steady-deviation detection; while the necessity of the varying-deviation detection is determined on the basis of the positional relationship (second relationship) between the marks 50K-50C formed by the identical ones of the image forming units 20K-20C. Because the relationship between the marks 50K-50C formed by the identical ones of the image forming units 20K-20C is less affected by the steady positional deviation, the cyclic positional deviation amounts can be accurately calculated.

Furthermore, if the magnitude of the cyclic positional deviation amount (the average value of the deviation from the ideal position) K_d_sum calculated from the first pattern P1 is equal to or greater than the first reference value R1, it is determined that the varying-deviation detection is necessary. Therefore, necessity of the varying-deviation detection can be accurately determined.

Furthermore, necessity of the varying-deviation detection is determined on the basis of the sum of the deviation amounts of the plurality of marks 50K-50C in the first pattern P1 from the respective ideal positions. This reduces the influence of a measurement error in each mark 50K-50C. Therefore, necessity of the varying-deviation detection can be still more accurately determined.

Furthermore, in accordance with increase in the operation amount of the printer 1 and in wearing out of the members, the cyclic fluctuation tends to become larger. In order to cope with this tendency, the first reference value R1 increases in accordance with the operation amount of the printer 1. This prevents excessively frequent execution of the varying-deviation correction.

Furthermore, because necessity of the varying-deviation detection is determined on the basis of the number of the sheets printed (the number of circulation of the belt 13)

counted after execution of the previous varying-deviation detection, the varying-deviation detection can be executed at suitable timings.

Furthermore, detachment and attachment of the process units 19K-19C (a part of the image forming units 20K-20C) causes a change in, for example, a meshing manner of the gears for transmitting the power from the printer body to the process units 19K-19C. Such a change can cause a change in the varying manner of the cyclic positional deviation. To follow this change, the varying-deviation detection is then executed, so that the detection can be executed at suitable timings.

Furthermore, the varying-deviation detection is executed only with respect to the one(s) of the image forming unit(s) 20K-20C having the detached and attached process unit(s) 19K-19C. Therefore, in comparison with execution of the varying-deviation detection always with respect to each of the image forming units 20K-20C, toner consumption can be reduced, and the time needed for the detection process can be saved.

Furthermore, detachment and attachment of the belt 13 for replacement and the like causes a change in, for example, a meshing manner of the gears for transmitting the power from the printer body to the belt 13. Such a change can cause a change in the varying manner of the cyclic positional deviation. To follow this change, the varying-deviation detection is then executed, so that the detection can be executed at suitable timings.

Second Illustrative Aspect

Next, a second illustrative aspect in accordance with the present invention will be described with reference to FIGS. 7, 10 and 11.

Figure 10:
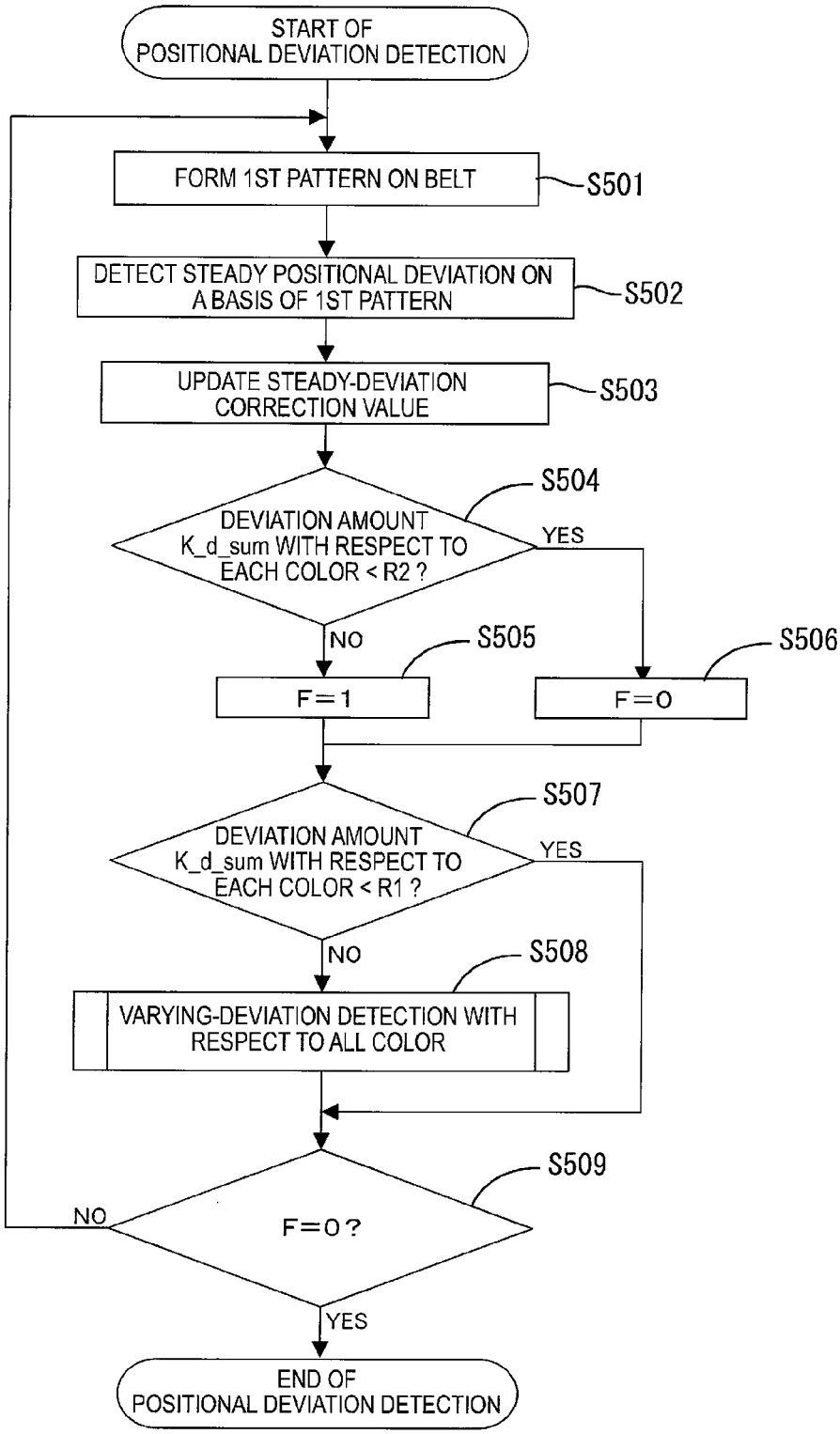
FIG. 10 is a flowchart illustrating a positional deviation detection process of a second illustrative aspect.
Figure 11:
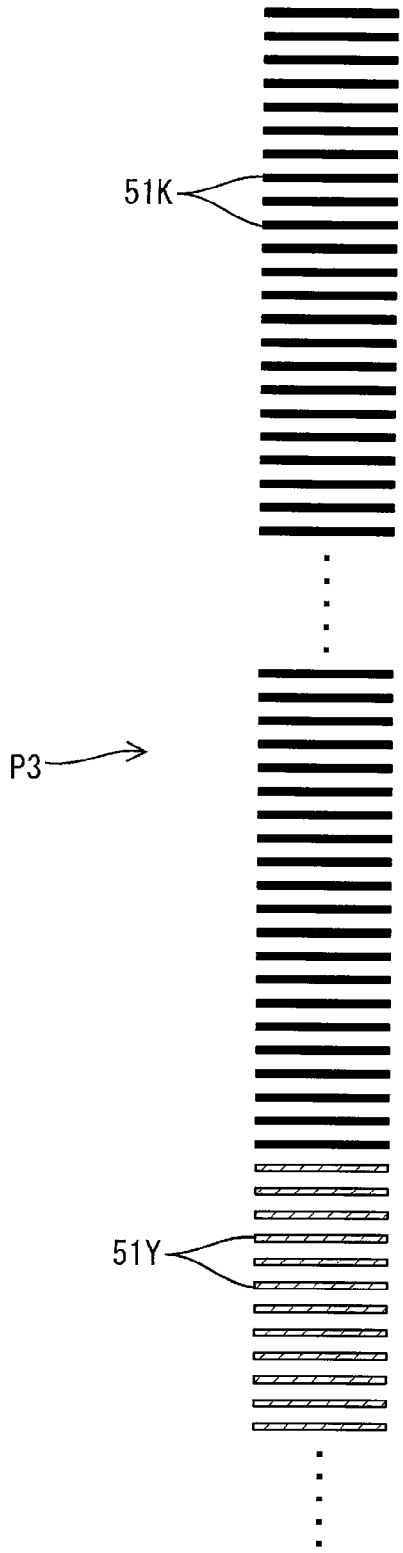
FIG. 11 is an illustration of a second pattern.

FIG. 10 is a flowchart illustrating a flow of a positional deviation detection process of the second illustrative aspect. FIG. 11 is an illustration of a second pattern P3. Note that description of the processing similar to the first illustrative aspect will be partly omitted in this illustrative aspect.

When the positional deviation detection process as shown in FIG. 10 starts, the first pattern P1 is formed on the belt 13 (S501), the first pattern P1 is measured to, and the measurement result is obtained. Then, the CPU 40 executes the steady-deviation detection on the basis of the measurement result (S502) and updates the steady-deviation correction values (S503). Next, the CPU 40 calculates the magnitude of the cyclic positional deviation amount (the average value of the deviation from the ideal position) K_d_sum with respect to each color and determines whether K_d_sum with respect to each color is less than a second reference value R2 (S504). As illustrated in FIG. 7, the second reference value R2 is uniform up to a point corresponding to a predetermined number of printed sheets while increases in accordance with the number of printed sheets counted from the point corresponding to the predetermined number of the printed sheets. In addition, the second reference value R2 is larger than the first reference value R1 by a predetermined amount.

If the magnitude of the cyclic positional deviation amount K_d_sum with respect to at least one of the colors is equal to or greater than the second reference value (S504: No), a flag F is set to 1 (S505). On the other hand, if K_d_sum with respect to each color is less than the second reference value R2 (S504: Yes), the flag F is set to 0 (zero) (S506).

Next, the CPU 40 determines whether the magnitude of the cyclic positional deviation amount K_d_sum with respect to each color is less than the first reference value R1 (S507). If K_d_sum with respect to at least one of the colors is equal to or greater than the first reference value R1 (S507: Yes), the CPU 40 executes the varying-deviation detection with respect to each of the image forming units 20K-20C (S508). In this illustrative aspect, while most part of the varying-deviation detection is similar to those of the flow illustrated in FIG. 4 of the first illustrative aspect, a second pattern P3 having mark groups in respective colors as illustrated in FIG. 11 is formed. These mark groups are arranged in the vertical scanning direction. In FIG. 11, only the mark groups of black marks 51K and the group of yellow marks 51Y are illustrated. On the basis of the measurement result of the second pattern P3, the CPU 40 detects the varying positional deviation amounts with respect to each color and updates the varying-deviation correction value for each color.

After executing the varying-deviation detection in S508 in FIG. 10, the CPU 40 determines whether the value of the flag F is 0 (zero) (S509). If the value of the flag F is 1 (S509: No), the process returns to S501 so that the steady-deviation detection (S501-S503) is re-executed. At this time, when re-forming the first pattern P1, the positional deviations are corrected on the basis of the varying-deviation correction values updated in the varying-deviation detection in S508. On the other hand, if the value of the flag F is 0 (zero) (S509: Yes), i.e. if the magnitude of the cyclic positional deviation amount K_d_sum with respect to each color is less than the second reference value R2, the CPU 40 terminates the positional deviation detection process.

It is assumed that the detection accuracy of the steady-deviation detection is lower when performed where the varying positional deviation amount is larger. In order to compensate this difficulty in such a case, in the second illustrative aspect, after the image forming positions are corrected on the basis of the result of the varying-deviation detection, the first pattern P1 is re-formed and the steady-deviation detection is re-executed, so that the accuracy of the steady-deviation detection can be ensured.

<Other Illustrative Aspects>

The present invention is not limited to the illustrative aspects described above with reference to the drawings. For example, the following illustrative aspects are also included within the scope of the present invention.

(1) In any one of the above illustrative aspects, necessity of the varying-deviation detection is determined illustratively on the basis of the measurement result of the first pattern P1 that is measured for detecting the steady positional deviation amounts. The present invention is not limited to this. In accordance with the present invention, on the contrary, it may be such that necessity of the steady-deviation detection is determined on the basis of the measurement result of the second pattern that is measured for detecting the varying positional deviation amounts. An illustration of this case is as follows: the second pattern P3 as illustrated in FIG. 11 is measured; on the basis of the measurement result of the second pattern P3, the deviation amounts of the yellow marks 51Y from the respective ideal positions based on the black marks 51K (the reference marks) is calculated; and, if each of the deviation amounts is equal to or larger than a predetermined reference value, it is determined that the steady-deviation detection is necessary.

(2) Any one of the above illustrative aspects illustrates the image forming apparatus of a transfer type that forms the patterns on the belt for conveying the sheets and thereby detects the positional deviation amounts. The present invention is not limited to this. The present invention may be adopted to an image forming apparatus of an intermediate transfer type that forms patterns on an intermediate transfer belt and thereby detects the positional deviation amounts.

(3) In any one of the above illustrative aspects, necessity of the varying-deviation detection is determined by detecting replacement of the belt and the process unit. The present invention is not limited to this. In accordance with the present invention, necessity of the varying-deviation detection may be determined in a manner such as follows: i) on the basis of a detection result of a means that detects detachment and attachment of members affecting the image forming positions; or ii) on the basis of information about detachment and attachment (replacement) of a member, which is inputted by the user using the operation unit.

(4) In any one of the above illustrative aspects, the positional deviation is corrected illustratively by adjusting the writing timings to the photosensitive drums for the exposure units. The present invention is not limited to this. For example, if the image forming apparatus is a type that exposes the photosensitive drums with laser light, the writing positions on the respective photosensitive drums may be adjusted by changing angles of mirrors interposed between the photosensitive drums and respective laser emitting units.

What is claimed is:

1. An image forming apparatus comprising:

a carrier configured to convey a recording medium;

a plurality of forming devices configured to form respective images at respective image forming positions on the recording medium, wherein the plurality of forming devices form a pattern on the carrier;

a measuring device configured to measure the pattern formed on the carrier; and a correcting device configured to execute a steady-deviation detection with respect to at least one of the plurality of forming devices and, based on a result of the steady-deviation detection, correct the image forming position of the at least of one of the plurality of forming devices, wherein:

in execution of the steady-deviation detection, the correcting device controls the plurality of forming devices to form a first pattern including a plurality of marks formed by the plurality of forming devices, controls the measuring device to measure the first pattern, and detects a steady deviation amount of the image forming position based on a measurement result of the first pattern by the measuring device, wherein the measurement result of the first pattern includes a first relationship between marks formed by different ones of the plurality of forming devices and a second relationship between marks formed by identical ones of the plurality of forming devices;

the correcting device is further configured to execute a varying-deviation detection, in which the correcting device controls at least one of the plurality of forming devices to form a second pattern, controls the measuring device to measure the second pattern, and detects a varying deviation amount of the image forming position based on a measurement result of the second pattern by the measuring device, the varying deviation amount of the image forming position having a cycle;

the correcting device executes the steady-deviation detection by calculating the steady deviation amount of the image forming position based on the first relationship, and determines a necessity of executing the varying-deviation detection by calculating a cyclic deviation amount of the image forming position based on the second relationship; and the correcting device further determines the necessity of executing the varying-deviation detection based on the measurement result of the first pattern obtained in the steady-deviation detection, and, upon determination that execution of the varying-deviation detection is necessary, executes the varying-deviation detection.

2. The image forming apparatus according to claim 1, wherein the correcting device determines the necessity of executing the varying-deviation detection with respect to each of the plurality of forming devices and executes the varying-deviation detection only with respect to forming devices for which the varying-deviation detection is determined to be necessary.

3. The image forming apparatus according to claim 1 further comprising a first reference value, wherein:

the correcting device calculates a magnitude of the cyclic deviation amount of the image forming position using deviation amounts of the marks in the second relationship from respective ideal positions, upon the magnitude of the cyclic deviation amount of the image forming position being equal to or more than the first reference value, the correcting device determines that the varying-deviation detection with respect to the respective one of the plurality of forming devices is necessary, and upon the magnitude of the cyclic deviation amount of the image forming position being less than the first reference value, the correcting device determines that the varying-deviation is unnecessary.

4. The image forming apparatus according to claim 3, wherein the correcting device calculates the magnitude of the cyclic deviation amount of the image forming position by averaging the deviation amounts of the marks in the second relationship from the respective ideal positions.

5. The image forming apparatus according to claim 3 further comprising a second reference value larger than the first reference value, wherein:

upon the magnitude of the cyclic deviation amount of the image forming position being equal to or larger than the second reference value, the correcting device re-executes the steady-deviation detection after executing the varying-deviation detection and correcting the image forming positions.

6. The image forming apparatus according to claim 3, wherein the first reference value is larger in accordance with enlargement of an operation amount of the image forming apparatus.

7. An image forming apparatus comprising:

a carrier configured to convey a recording medium;

a plurality of forming devices configured to form respective images at respective image forming positions on the recording medium, wherein the plurality of forming devices form a pattern on the carrier;

a measuring device configured to measure the pattern formed on the carrier; and a correcting device configured to execute a steady-deviation detection with respect to at least one of the plurality of forming devices and, based on a result of the steady-deviation detection, correct the image forming position of the at least of one of the plurality of forming devices, wherein:

in execution of the steady-deviation detection, the correcting device controls the plurality of forming devices to form a first pattern, controls the measuring device to measure the first pattern, and detects a steady deviation amount of the image forming position based on a measurement result of the first pattern by the measuring device;

the correcting device is further configured to execute a varying-deviation detection, in which the correcting device controls at least one of the plurality of forming devices to form a second pattern, controls the measuring device to measure the second pattern, and detects a varying deviation amount of the image forming position based on a measurement result of the second pattern by the measuring device, the varying deviation amount of the image forming position having a cycle;

the correcting device determines a necessity of executing the varying-deviation detection based on the measurement result of the first pattern obtained in the steady-deviation detection, and, upon determination that execution of the varying-deviation detection is necessary, executes the varying-deviation detection; and the correcting device further determines the necessity of executing the varying-deviation detection with respect to each of the plurality of forming devices and executes the varying-deviation detection only with respect to forming devices for which the varying-deviation detection is determined to be necessary.

* * * * *